US008621774B1

(12) United States Patent
Kley

(10) Patent No.: US 8,621,774 B1
(45) Date of Patent: Jan. 7, 2014

(54) FIREARM WITH MULTIPLE TARGETING LASER DIODES

(75) Inventor: Victor B. Kley, Berkeley, CA (US)

(73) Assignee: Metadigm LLC, Berkeley, CA (US)

( * ) Notice: Subject to any disclaimer, the term of this patent is extended or adjusted under 35 U.S.C. 154(b) by 0 days.

(21) Appl. No.: 12/855,633

(22) Filed: Aug. 12, 2010

Related U.S. Application Data

(60) Continuation of application No. 12/236,214, filed on Sep. 23, 2008, now abandoned, which is a division of application No. 11/091,016, filed on Mar. 25, 2005, now Pat. No. 7,441,362.

(60) Provisional application No. 60/557,470, filed on Mar. 29, 2004.

(51) Int. Cl.
*F41G 3/00* (2006.01)

(52) U.S. Cl.
USPC ..... 42/114; 33/276; 356/247

(58) Field of Classification Search
USPC ..... 42/111, 113, 114, 115, 116; 33/286, 33/290, 293, 297, 298, 295; 124/87; 356/153, 241.2, 247
See application file for complete search history.

(56) References Cited

U.S. PATENT DOCUMENTS

| | | | | | |
|---|---|---|---|---|---|
| 3,292,492 | A | * | 12/1966 | Sturtevant | 89/128 |
| 4,023,465 | A | * | 5/1977 | Inskip | 89/131 |
| 4,170,071 | A | * | 10/1979 | Mann et al. | 33/265 |
| 4,325,190 | A | * | 4/1982 | Duerst | 33/265 |
| 4,624,641 | A | | 11/1986 | Gallagher | |
| 4,948,371 | A | | 8/1990 | Hall | |
| 5,060,391 | A | | 10/1991 | Cameron et al. | |
| 5,215,465 | A | | 6/1993 | Marshall et al. | |
| 5,316,479 | A | * | 5/1994 | Wong et al. | 434/11 |
| 5,425,299 | A | * | 6/1995 | Teetzel | 89/14.4 |
| 5,476,385 | A | | 12/1995 | Parikh et al. | |
| 5,517,896 | A | * | 5/1996 | Perrine | 89/189 |
| 5,551,876 | A | | 9/1996 | Koresawa et al. | |
| 5,603,179 | A | * | 2/1997 | Adams | 42/70.08 |
| 5,614,942 | A | | 3/1997 | Rom | |
| 5,782,028 | A | * | 7/1998 | Simon et al. | 42/70.11 |
| 5,784,821 | A | * | 7/1998 | Gerard | 42/84 |
| 5,937,557 | A | * | 8/1999 | Bowker et al. | 42/70.01 |
| 5,937,558 | A | * | 8/1999 | Gerard | 42/84 |

(Continued)

FOREIGN PATENT DOCUMENTS

WO 03/087699 10/2003

OTHER PUBLICATIONS

ASTM F2094 $Si_3N_4$ Cerbec Ball Specifications, Saint-Gobain Ceramics [online], [retrieved on Aug. 2005]. Retrieved from the internet <URL: http://www.cerbec.com/TechInfo/TechSpec.asp>.

(Continued)

*Primary Examiner* — Benjamin P Lee
(74) *Attorney, Agent, or Firm* — Kilpatrick Townsend & Stockton LLP

(57) ABSTRACT

All or some of the component parts of a firearm are made of synthetic diamond materials. Some firearms include a specially designed trigger capable of verifying a user's identity so that only an authorized user can discharge the firearm. Some firearms include a diamond barrel designed to impart a unique pattern of grooves to any bullet leaving the barrel, thereby facilitating reliable identification of the firearm that fired a particular bullet.

10 Claims, 3 Drawing Sheets

(56) References Cited

U.S. PATENT DOCUMENTS

| | | | | |
|---|---|---|---|---|
| 6,144,028 | A * | 11/2000 | Kley | 250/234 |
| 6,199,286 | B1 * | 3/2001 | Reed et al. | 33/265 |
| 6,230,431 | B1 * | 5/2001 | Bear | 42/117 |
| 6,252,226 | B1 * | 6/2001 | Kley | 250/306 |
| 6,257,893 | B1 * | 7/2001 | Trabut | 434/11 |
| 6,286,240 | B1 | 9/2001 | Collins | |
| 6,337,479 | B1 * | 1/2002 | Kley | 250/234 |
| 6,339,217 | B1 | 1/2002 | Kley | |
| 6,339,219 | B1 * | 1/2002 | Ishizuya et al. | 250/330 |
| 6,343,140 | B1 * | 1/2002 | Brooks | 382/115 |
| 6,481,140 | B1 * | 11/2002 | Marshall | 42/70.11 |
| 6,563,940 | B2 * | 5/2003 | Recce | 382/120 |
| 6,631,579 | B1 | 10/2003 | Lauster et al. | |
| 6,663,391 | B1 | 12/2003 | Otowa | |
| 6,763,126 | B2 * | 7/2004 | Recce | 382/120 |
| 6,854,975 | B2 * | 2/2005 | Ranzinger | 434/16 |
| 6,887,079 | B1 | 5/2005 | Robertsson et al. | |
| 6,925,742 | B1 * | 8/2005 | Van Zyl | 42/70.01 |
| 6,942,486 | B2 | 9/2005 | Lvovskiy | |
| 6,966,775 | B1 | 11/2005 | Kendir et al. | |
| 7,036,258 | B1 * | 5/2006 | Lee et al. | 42/70.06 |
| 7,281,397 | B2 * | 10/2007 | Victor | 70/58 |
| 7,363,742 | B2 | 4/2008 | Nerheim | |
| 7,441,362 | B1 | 10/2008 | Kley | |
| 7,926,408 | B1 | 4/2011 | Kley | |
| 2001/0042332 | A1 * | 11/2001 | Gering et al. | 42/70.08 |
| 2002/0112390 | A1 * | 8/2002 | Harling et al. | 42/70.11 |
| 2003/0136043 | A1 * | 7/2003 | Lauster et al. | 42/70.11 |
| 2003/0163941 | A1 * | 9/2003 | Herzog | 42/70.07 |
| 2004/0031180 | A1 * | 2/2004 | Ivanov | 42/70.11 |
| 2004/0146840 | A1 | 7/2004 | Hoover et al. | |
| 2006/0048432 | A1 | 3/2006 | Staley | |
| 2006/0152786 | A1 | 7/2006 | Takakuwa et al. | |
| 2006/0191182 | A1 | 8/2006 | Curry et al. | |
| 2007/0009860 | A1 | 1/2007 | Young | |
| 2007/0044365 | A1 | 3/2007 | Deken | |
| 2007/0077539 | A1 | 4/2007 | Tzidon et al. | |
| 2007/0089598 | A1 | 4/2007 | Courty | |
| 2007/0190495 | A1 | 8/2007 | Kendir et al. | |
| 2007/0238073 | A1 | 10/2007 | Portoghese et al. | |
| 2009/0071055 | A1 | 3/2009 | Kley | |

OTHER PUBLICATIONS

"Germanium on silicon near infrared photodetectors," Nonlinear Optics and Optoelectronics Lab, University Roma Tre (Italy) [online], [retrieved on Aug. 2, 2005]. Retrieved from the internet <URL:http://optow.ele.uniroma3.it/optow__2002/labs/SiGeNIR%20files/SiGeNIR.htm >.

Komanduri et al., "Finishing of Silicon Nitride Balls," Oklahoma State University [online], [retrieved on Oct. 24, 2005]. Retreived from the internet <:URL http://asset.okstate.edu/asset/finish.htm (updated Aug. 21, 2003).

Stoldt et al., "Novel Low-Temperature CVD Process for Silicon Carbide MEMS" (preprint), Department of Chemical Engineering, University of California, Berkeley, CA., pp. 1-4. (2007).

Definition of "bullet" from website www.askoxford.com.

Non-Final Office Action of Jun. 12, 2008 for U.S. Appl. No. 11/564,133, 12 pages.

Final Office Action of Jul. 15, 2009 for U.S. Appl. No. 11/564,133, 9 pages.

Notice of Allowance of Nov. 2, 2010 for U.S. Appl. No. 11/564,133, 9 pages.

Non-Final Office Action of Jun. 7, 2007 for U.S. Appl. No. 11/091,016, 11 pages.

Final Office Action of Feb. 14, 2008 for U.S. Appl. No. 11/091,016, 11 pages.

Notice of Jun. 23, 2008 for U.S. Appl. No. 11/091,016, 7 pages.

Non-Final Office Action of Feb. 17, 2009 for U.S. Appl. No. 12/236,214, 8 pages.

Final Office Action of Sep. 11, 2009 for U.S. Appl. No. 12/236,214, 9 pages.

* cited by examiner

FIREARM WITH MULTIPLE TARGETING LASER DIODES

CROSS REFERENCE TO RELATED APPLICATIONS

This application is a continuation of U.S. patent application Ser. No. 12/236,214, filed Sep. 23, 2008, entitled "Firearm with Multiple Targeting Laser Diodes (as amended)," which is a divisional of U.S. patent application Ser. No. 11/091,016, filed Mar. 25, 2005, now U.S. Pat. No. 7,441,362, entitled "Firearm with Force Sensitive Trigger and Activation Sequence," which claims the benefit of U.S. Provisional Application No. 60/557,470, filed Mar. 29, 2004, entitled "Diamond and/or Silicon Carbide Molding of Small and Microscale or Nanoscale Capsules and Other Objects Including Firearms." The respective disclosures of all three applications are incorporated herein by reference for all purposes.

The present disclosure is related to the following commonly-assigned co-pending U.S. Patent Applications:

application Ser. No. 11/046,526, filed Jan. 28, 2005, entitled "Angle Control of Multi-Cavity Molded Components for MEMS and NEMS Group Assembly";

application Ser. No. 11/067,517, filed Feb. 25, 2005, entitled "Diamond Capsules and Methods of Manufacture;"

application Ser. No. 11/067,609, filed Feb. 25, 2005, entitled "Apparatus for Modifying and Measuring Diamond and Other Workpiece Surfaces with Nanoscale Precision"; and application Ser. No. 11,079,019 filed Mar. 11, 2005, entitled "Silicon Carbide Stabilizing of Solid Diamond and Stabilized Molded and Formed Diamond Structures."

The respective disclosures of these applications are incorporated herein by reference for all purposes.

RELATED DOCUMENTS INCORPORATED BY REFERENCE

The following U.S. Patents are incorporated by reference:

U.S. Pat. No. 6,144,028, issued Nov. 7, 2000, entitled "Scanning Probe Microscope Assembly and Corresponding Method for Making Confocal, Spectrophotometric, Near-Field, and Scanning Probe Measurements and Forming Associated Images from the Measurements";

U.S. Pat. No. 6,252,226, issued Jun. 26, 2001, entitled "Nanometer Scale Data Storage Device and Associated Positioning System";

U.S. Pat. No. 6,337,479, issued Jan. 8, 2002, entitled "Object Inspection and/or Modification System and Method"; and U.S. Pat. No. 6,339,217, issued Jan. 15, 2002, entitled "Scanning Probe Microscope Assembly and Method for Making Spectrophotometric, Near-Field, and Scanning Probe Measurements."

Attached hereto is a document entitled "Appendix A: Background Information" (16 pages) with the following subsections:

ASTM F2094 $Si_3N_4$ CERBEC BALL SPECIFICATIONS;

Surface Finish—Finishing of Silicon Nitride Balls;

PI piezoelectric web page; and

Germanium on silicon near infrared photodetectors.

This document is to be considered a part of this application and is hereby incorporated by reference.

Also attached hereto is a document entitled "Novel Low-Temperature CVD Process for Silicon Carbide MEMS," by C. R. Stoldt, C. Carraro, W. R. Ashurst, M. C. Fritz, D. Gao, and R. Maboudian, Department of Chemical Engineering, University of California, Berkeley, Calif. 94720 USA (4 pages). This document is also to be considered a part of this application and is hereby incorporated by reference.

BACKGROUND OF THE INVENTION

The present invention relates in general to firearms, and in particular to a firearm made from a molded diamond material.

From shotguns to rifles to handguns, firearms have proven to be a valuable tool for law enforcement and self defense. Sadly, however, firearms have also proven to be a valuable tool for criminals, who use them to threaten, injure, or murder their victims. Too often, the criminals cannot be identified, either because the weapon that fired a bullet cannot be reliably identified or because the weapon was stolen from its owner and the shooter cannot be reliably connected to the weapon. In addition, many people are injured or killed each year through accidental discharge of firearms, including children playing with a parent's gun.

Attempts to solve these problems include trigger locks and ballistic fingerprinting. While they are of some help, both solutions are imperfect. Trigger locks, for example, keep unauthorized users (particularly children) from operating a firearm, but they can also interfere with legitimate users' ability to respond quickly to a deadly threat. Further, because a criminal can steal a firearm and remove the lock at his or her leisure, trigger locks do little to prevent stolen firearms from being used in further crimes.

Ballistic fingerprinting attempts to match grooves imparted to a bullet by a gun barrel to the barrel of a particular firearm. The technique is sometimes successful; however, it has been demonstrated that over time, the grooves imparted by a particular barrel can change (e.g., due to wear and tear if the gun is repeatedly fired); moreover, firearms manufacturers generally do not design their barrels to provide a unique signature, so differences are largely accidental, making ballistic fingerprinting, at best, an inexact science.

Therefore, it would be desirable to provide firearms with improved protection against unauthorized use and improved ability to identify a particular firearm as the source of a bullet.

BRIEF SUMMARY OF THE INVENTION

Embodiments of the present invention provide firearms in which all or some of the component parts are made of synthetic diamond materials. In some embodiments, the firearm includes a specially designed trigger capable of verifying a user's identity so that only an authorized user can discharge the firearm. For example, the firearm can be programmed with a time sequence of pressures (which may vary or remain constant) that a user exerts on the trigger to activate the firearm.

In some embodiments, the firearm also includes a diamond barrel designed to impart a unique pattern of grooves to any bullet leaving the barrel, thereby facilitating reliable identification of the firearm that fired a particular bullet.

In still further embodiments, numerous other features are provided. For instance, in one embodiment, the firearm is held in the user's palm with the barrel extending between the user's second and third fingers. In another embodiment, the firearm has a cylinder with radially oriented chambers that can be loaded with a powder charge and a bullet (or shot wad or other type of ammunition) as the chamber rotates past a powder aperture and a bullet tube.

The amount of powder in the charge can be regulated by regulating the speed at which the chamber rotates; piezoelectric or other suitable motors can be used to control rotation of the chamber.

In still other embodiments, the powder (or other propellant) charge is ignited by passage of a current through an electrically sensitive material at the base of the bullet (or other ammunition). An insulating diamond member that is made conductive through application of an ultraviolet light pulse can be used to gate or switch the current in response to operation of the firearm's trigger, initiating combustion of the propellant charge. In conjunction with the user recognition mechanisms described herein, this technique provides a reliable safety for the firearm.

The following detailed description together with the accompanying drawings will provide a better understanding of the nature and advantages of the present invention.

DESCRIPTION OF SPECIFIC EMBODIMENTS

The related patent applications incorporated by reference above describe, inter alia:

- various techniques and apparatus for growing diamond materials on suitably shaped substrates to create diamond structures having arbitrary shapes, including but not limited to spherical capsules suitable for use as ball-bearings, non-spherical shapes such as cylindrical gear-tooth bearings, and angled probe tips for atomic force microscopy (AFM), scanning probe microscopy (SPM) and similar applications (see, e.g., application Ser. No. 11/046,526 and application Ser. No. 11/067,517);
- various techniques for joining together separately fabricated diamond parts into an assembly, including the shaping of parts with interference members capable of holding the assembled parts together and use of various bonding materials for different operating temperatures (see, e.g., application Ser. No. 11/067,517);
- various techniques and apparatus for coating carbon diamond parts with silicon carbide to stabilize the parts against oxidation (see, e.g., application Ser. No. 11/079,019; and
- various techniques and apparatus for measuring and modifying surfaces of such parts at nanoscale precision (see, e.g., application Ser. No. 11/067,609).

In embodiments of the present invention, such techniques can be used to fabricate a firearm with all or some parts being made of synthetic diamond materials. In some embodiments, the firearm includes a specially designed trigger capable of verifying a user's identity, e.g., via a pressure-sensitive trigger coupled to computing and logic circuitry capable of recognizing a preprogrammed pattern of pressures on the trigger, so that only an authorized user can discharge the firearm. In some embodiments, the firearm also includes a diamond barrel designed to impart a unique pattern of grooves to any bullet leaving the barrel, thereby facilitating reliable identification of the firearm that fired a particular bullet.

As used herein, the term "diamond" or "diamond material" refers generally to any material having a diamond lattice structure on at least a local scale (e.g., a few nanometers), and the material may be based on carbon atoms, silicon atoms, boron atoms, silicon carbide, silicon nitride, boron carbide, boron nitride, or any other atoms or combination of atoms capable of forming a diamond lattice.

Figure 1A:
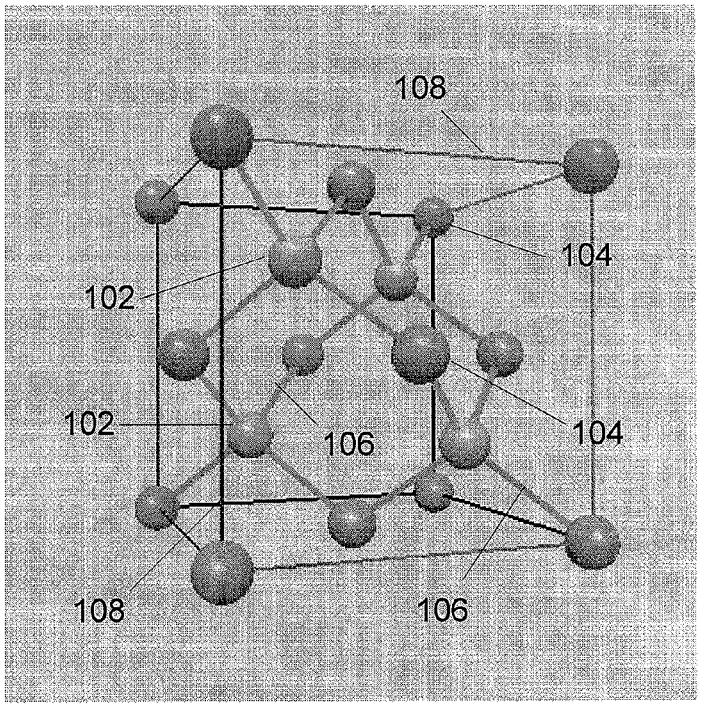
FIG. 1A (Prior Art)
FIGS. 1A and 1B are schematic illustrations of diamond and graphite atomic lattices, respectively.

For example, a diamond material may include crystalline diamond. As is well known in the art, a crystal is a solid material consisting of atoms arranged in a lattice, i.e., a repeating three-dimensional pattern. In crystalline diamond, the lattice is a diamond lattice 100 as shown in FIG. 1A. Diamond lattice 100 is made up of atoms 102 connected by sp3 bonds 106 in a tetrahedral configuration. (Lines 108 are visual guides indicating edges of a cube and do not represent atomic bonds.) As used herein, the term "diamond" refers to any material having atoms predominantly arranged in a diamond lattice as shown in FIG. 1A and is not limited to carbon atoms or to any other particular atoms. Thus, a "diamond material" may include predominantly carbon atoms, silicon atoms, boron atoms, silicon carbide, silicon nitride, boron carbide, boron nitride, and/or atoms of any other type(s) capable of forming a diamond lattice, and the term "diamond" as used herein is not limited to carbon-based diamond.

In other embodiments, the diamond material is an imperfect crystal. For example, the diamond lattice may include defects, such as extra atoms, missing atoms, or dopant or impurity atoms of a non-majority type at lattice sites; these dopant or impurity atoms may introduce non-sp3 bond sites in the lattice, as is known in the art. Dopants, impurities, or other defects may be naturally occurring or deliberately introduced during fabrication of a diamond part.

In still other embodiments, the diamond material is made of polycrystalline diamond. As is known in the art, polycrystalline diamond includes multiple crystal grains, where each grain has a relatively uniform diamond lattice, but the grains do not align with each other such that a continuous lattice is preserved across the boundary. The grains of a polycrystalline diamond material might or might not have a generally preferred orientation relative to each other, depending on the conditions under which the material is fabricated. In some embodiments, the size of the crystal grains can be controlled so as to form nanoscale crystal grains; this form of diamond is referred to as "nanocrystalline diamond." For example, the average value of a major axis of the crystal grains in nanocrystalline diamond can be made to be about 100 nm or less.

Figure 1B:
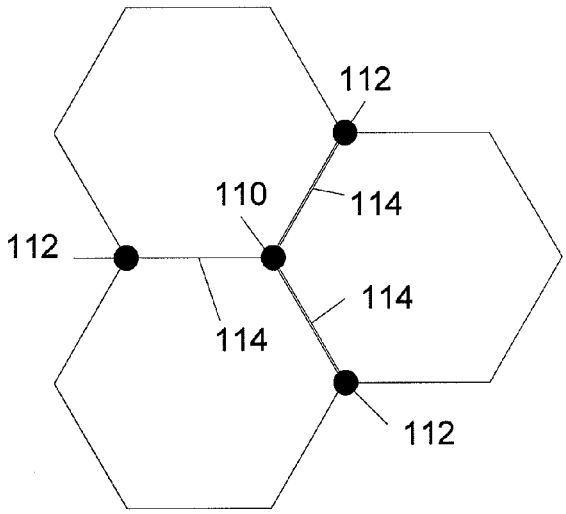
FIG. 1B (Prior Art)

In still other embodiments, the diamond material is made of amorphous diamond. Amorphous diamond does not have a large-scale diamond lattice structure but does have local (e.g., on the order of 10 nm or less) diamond structure around individual atoms. In amorphous diamond, a majority of the atoms have $sp^3$-like bonds to four neighboring atoms, and minority of the atoms are bonded to three other atoms in a $sp^2$-like bonding geometry, similar to that of graphite; FIG. 1B depicts graphite-like $sp^2$ bonds 114 between an atom 110 and three other atoms 112. The percentage of minority ($sp^2$-bonded) atoms may vary; as that percentage approaches zero over some area, a crystal grain becomes identifiable.

Thus, it is to be understood that the terms "diamond material" and "diamond" as used herein include single-crystal diamond, polycrystalline diamond (with ordered or disordered grains), nanocrystalline diamond, and amorphous diamond, and that any of these materials may include defects and/or dopants and/or impurities. Further, the distinctions between different forms of diamond material are somewhat arbitrary not always sharp; for example, polycrystalline diamond with average grain size below about 100 nm can be labeled nanocrystalline, and nanocrystalline diamond with grain size below about 10 nm can be labeled amorphous.

A diamond part may include multiple layers or components made of diamond material, and different layers or components may have different composition. For example, some but not all layers might include a dopant; different polycrystalline oriented layers might have a different preferred orientation for their crystal grains or a different average grain size; some layers might be polycrystalline oriented diamond while others are polycrystalline disoriented, and so on. In addition, coatings or implantations of atoms that do not form diamond lattices may be included in a diamond material.

A diamond part, such as the firearm described herein, may be fabricated as a unitary diamond structure, which may include crystalline, polycrystalline or amorphous diamond. Alternatively, the part may be fabricated in sections, each of which is a unitary diamond structure, with the sections being joined together after fabrication.

Figure 2A:
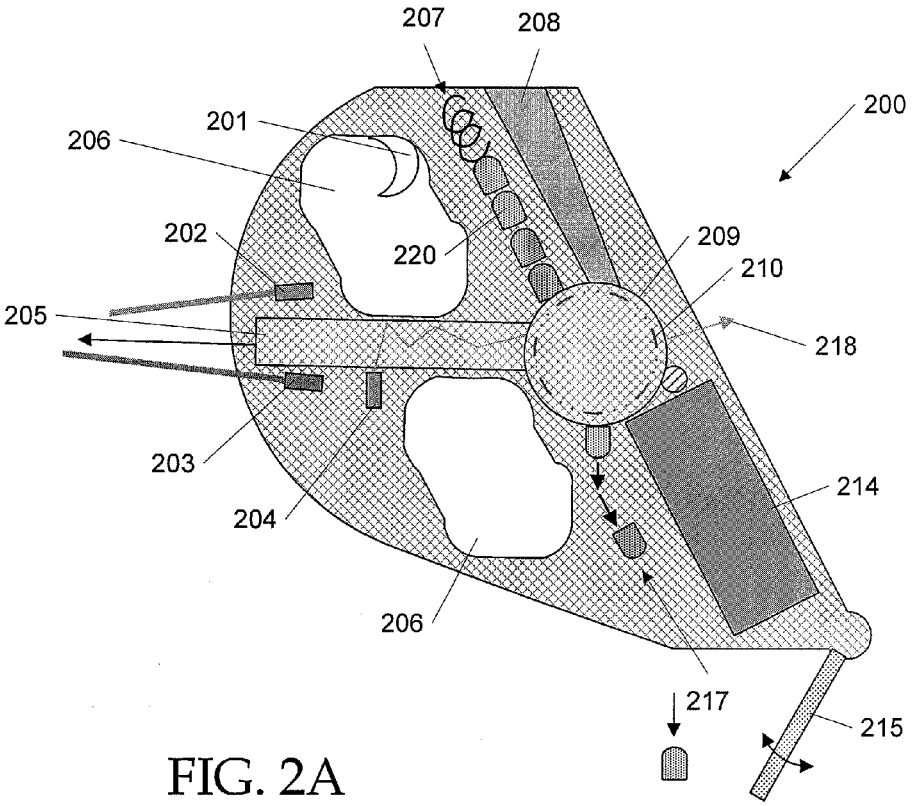
FIGS. 2A-2E are views of a firearm according to an embodiment of the present invention.
Figure 2B:
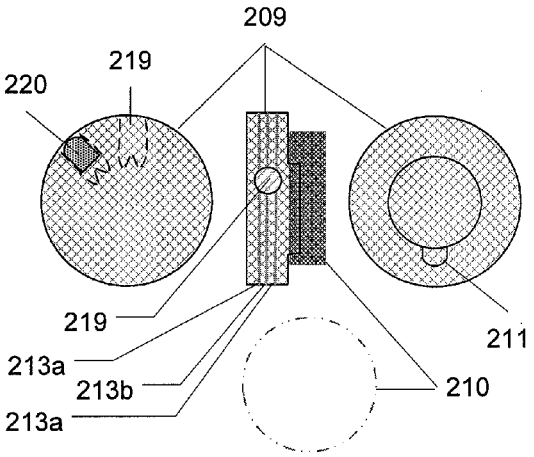
Figure 2C:
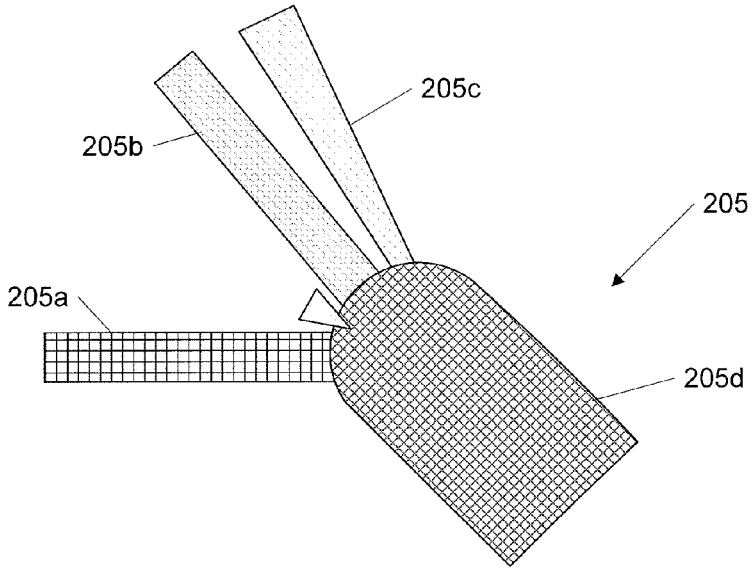
Figure 2D:
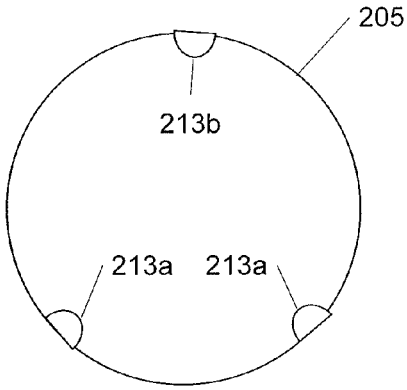
Figure 2E:
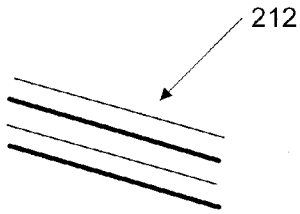

FIG. 2A-2E illustrate a muzzle loading firearm according to an embodiment of the present invention. FIG. 2A is a side cutaway view of the firearm 200. A user grips firearm 200 by slipping two fingers through each grip opening 206 and wrapping his or her thumb around the body so that the user's first (index) finger rests on trigger 201 and barrel 205 extends between the user's second and third fingers. Firearm 200 advantageously includes a control and battery unit 214 operatively coupled to trigger 201 and to a cylinder 209 into which bullets 220 are loaded with a radial orientation as cylinder 209 rotates about an axis transverse to the plane of FIG. 2A. FIG. 2B is an exploded view showing further detail of cylinder 209 from both sides and the front. FIG. 2C is a side view showing barrel designs. FIG. 2D is a cross sectional view of barrel 205 at the interface to cylinder 209. FIG. 2E illustrates a rifling pattern that may be used in barrel 205.

In operation, a force sensing trigger 201, which may include a piezoelectric or piezo resistive element (not shown but well known to those skilled in the art), is pressed one or more times in an activation sequence. The activation sequence includes a specific pattern of pressures or pulses on the trigger 201, and the pattern may be defined by reference to a relative duration of the pulses and/or relative force on the trigger as a function of time. The activation sequence is advantageously preprogrammed by the user, e.g., upon purchasing the firearm, and stored in memory in control and battery circuit 214. When trigger 201 is operated, signals representing the force as a function of time are transmitted to control and battery unit 214, which compares them to the activation sequence, with the firearm becoming usable only when the trigger operations match the preprogrammed activation sequence. This sequence acts as a "password" to prevent the firearm from being used by anyone other than an authorized user. In other embodiments, other user identification techniques, such as fingerprint or DNA matching, could be used instead of or in addition to the activation sequence described herein.

When the activation sequence is recognized by control and battery unit 214, a force and time pattern LED 204 is turned on, signifying that the user has been recognized and that the arm is ready for use. If there is no bullet or shot wad aligned with the barrel 205, then a portion of the light from LED 204 will be visible at 218. In some embodiments, light from LED 204 may also be visible at the muzzle end of barrel 205.

Targeting laser diodes 202, 203 may also be turned on at this time. In one embodiment, laser diodes 202 and 203 provide laser beams of different colors to guide the user's aim, compensating for trajectory, at two different distances. In another embodiment, laser diodes 202 and 203 may be distinguished by the projected shapes of their light beams (e.g., one might be round while the other is rectangular).

Pressing the trigger 201 again with a user-selected "loading" force will cause control and battery system 214 to load the firearm. Specifically, control and battery system 214 activates a rotation mechanism 210 (e.g., a piezoelectric motor that acts on a boss 211 on a surface of cylinder 209) to rotate the cylinder 209 at a predetermined speed past a powder column 208. As cylinder 209 rotates past column opening 208, an empty chamber 219 in cylinder 209 is charged with powder; the charge can be controlled by regulating the rotation speed of cylinder 209. A bullet 220 is then loaded on top of the powder charge in chamber 219. Further rotation puts the bullet in contact with a first set of bumps 213*a* at the inner end of barrel 205, which further seat the bullet until a bump 213*b* on the chamber comes into electrical contact with a third (center) bump on barrel 205 or with another electrical contact element, which may be located in barrel 205 or chamber 219 or on the surface of cylinder 209. In other embodiments, bumps and/or other contact elements are advantageously arranged on surfaces of barrel 205, cylinder 209, and/or chamber 219 such that a circuit is completed only when a bullet in a chamber 219 is properly aligned with barrel 205. When the circuit is completed, the weapon is ready to fire.

When trigger 201 is pressed again, a feedback signal (e.g., a vibration, acoustic wave, electrical signal, thermal change or any or all of the above) is advantageously passed through the trigger 201; where trigger 201 includes a piezoelectric element, the feedback signal can be driven electrically by the controller/battery 214. At this time the controller 214 also sends a high voltage pulse through the rotatable cylindrical section 209 that now contains bullet(s) 220 and powder in the radial chambers 219 along its circumference. Only the bullet aligned with the barrel 205 can complete the electrical circuit and ignite the powder, which drives the bullet 220 down the barrel 205.

In preferred embodiments, barrel 205 is rifled with a pattern unique to an individual firearm 200. An example rifling pattern 212 using grooves of two different widths is shown in FIG. 2E. As a bullet 220 passes through barrel 205, the rifling pattern imparts to the bullet casing a pattern of fine lands and grooves of varying widths and spacings, along with a stabilizing rotation. For a .50 caliber weapon with circumference of $\pi$*diameter, a 64 bit bar code word (allowing $10^{19}$ distinct serial numbers) could be used, with a space of 0.025" for each narrow land (0.008") or wide land (0.016") representing a one or zero These dimensions are consistent with known "microgroove" rifling techniques used in the art. In some embodiments, where barrel 205 is made of a diamond material that is optically transparent at some wavelength, it is possible to read the rifling pattern using various optical measurements at that wavelength without discharging the firearm.

After a bullet is fired, the process can be repeated, with control and battery unit 214 operating piezoelectric rotator 210 in response to trigger 201 to rotate cylinder 209, thereby loading and positioning the next round. To unload firearm 200, operating trigger 201 by applying an "unload" sequence of pressures causes bottom flap 215 to open. Cylinder 209 is then rotated such that bullets 220 are passed down an ejection path 217 and ejected as shown.

The main body and other components of firearm 200 are advantageously made of a diamond material such as carbon-based diamond or silicon carbide. In some embodiments, the components are made of carbon-based diamond materials coated with silicon carbide. Various fabrication techniques can be used, including fabrication on sacrificial (e.g., barrel forms 205*a*, 205*b*, 205*c*) or reusable (e.g., half-cylinder form 205*d*) substrates formed to the desired shape of the component. The barrel is evenly coated with diamond to a sufficient depth (typically 150 microns) to provide adequate burst strength, machined at one end to match the curvature of the cylinder form, then put in place with other components that can be made by similar techniques. A final diamond coating may be grown to integrate and fix the various parts in position.

While all components of firearm 200 can be made of diamond material, this is not required. Barrel 205 and firing mechanism 209 are advantageously made of diamond materials; other components can be made of other materials, including steel and other metals conventionally used in firearms. Bullets 220 may be of generally conventional design and materials. In preferred embodiments, the body of firearm 200 includes at least some metal elements large enough to be readily detected by conventional metal detectors (e.g., as used in airports); such elements help to deter unauthorized concealed carrying of firearm 200.

In another embodiment, a spiral bullet feed tube may be placed around a central powder column 208. If the dimensions of the spiral are about 1.75 inches by 4 inches for a typical arm of .5 caliber, the total tube length is about 20 inches. If there are 10 inches of spring or 20 bullets, a constant force spring would produce a capacity of about 40 rounds.

While the invention has been described with respect to specific embodiments, one skilled in the art will recognize that numerous modifications are possible. One skilled in the art will also recognize that the present invention provides a number of advantageous techniques, tools, and products, usable individually or in various combinations. These techniques, tools, and products include but are not limited to:

- a firearm barrel or firing mechanism constructed of diamond, silicon carbide coated diamond, any combination of oxides, nitrides or carbides coating diamond, silicon carbide, or silicon nitride; and/or
- a firearm in which the barrel is mounted between the second and third fingers with the action in the palm; and/or
- a firearm in which a unique pattern of rifling is specifically made for each individual firearm; and/or
- a firearm with a unique pattern of rifling in which the rifling is in a transparent or nearly transparent barrel and can be read, recognized or recorded by external means not requiring a discharge of the weapon; and/or
- a firearm in which light can be directed down the barrel and will be visible (from at least one end opposite the light injection) only if there is no bullet, cartridge or powder in the barrel; and/or
- a firearm controlled by a pressure or force sensitive trigger; and/or
- a firearm in which a particular time series of pressures on the trigger (which may be varying or non-varying pressures) causes a particular action including but not limited to making the arm operational for firing; and/or
- a firearm consisting of at least one rotating member with radially bored chambers or cavities into which powder and shot or bullets are loaded; and/or
- a firearm in which powder is fed from an aperture, in which the powder charge is regulated by controlling the aperture size and/or the speed of passage of the chamber past the aperture from which the powder is fed; and/or
- a firearm in which the chambers in a revolving element are driven by a piezoelectric rotator; and/or
- a firearm in which a bullet is aligned with the barrel by detecting its position vis a vis the barrel electrically, acoustically or optically; and/or
- a firearm having two or more laser diodes of different colors or projected shapes which are pointed to be exactly on target compensating for bullet trajectory at two or more distances; and/or
- a firearm in which the proper user is determined by finger print recognition; and/or
- a firearm in which the proper user is determined by DNA recognition; and/or
- a firearm in which the proper user is determined by any combination of full or partial finger print recognition, and/or full or partial DNA recognition and/or full or partial pressure pattern recognition; and/or
- a muzzle loading firearm in which the powder charge is ignited by passage of a current through an electrically sensitive material on the base of the bullet or shot wad; and/or
- a firearm in which the powder charge is ignited by passage of a current through an electrically sensitive material on the base of the bullet or shot wad, wherein one element of the control switch is a section of insulating diamond made conductive by a pulse or continuous ultraviolet light; and/or
- a firearm or similar device in which the pressure or force sensing member can also send force, pressure, acoustical, electrical, or thermal changes back to the operator's finger; and/or
- a firearm in which the bullet feed tube is spiral around a centrally located powder compartment.

It should be noted that several of the features of firearms described herein do not require that any part of the firearm be made of diamond material or any other particular material. Such features can be applied to firearms made of other materials, including conventional materials.

Thus, although the invention has been described with respect to specific embodiments, it will be appreciated that the invention is intended to cover all modifications and equivalents within the scope of the following claims.

What is claimed is:

1. A firearm having two or more distinguishable laser diodes, each of the laser diodes being positioned to direct a respective laser beam onto a target, wherein:

at least first and second of the respective laser beams are directed at different angles relative to the firearm; and the first and second beams form respective first and second spots on the target, the relative positions of the first and second spots depending on the distance from the firearm to the target, thereby helping the user compensate for bullet trajectory.

2. A firearm according to claim 1 wherein the distinguishable laser diodes each emit a beam of a different color.

3. A firearm according to claim 1 wherein the distinguishable laser diodes each emit a beam of a different projected shape.

4. A firearm for directing a projectile toward a target, the firearm comprising:

a barrel through which the projectile is launched, the barrel being characterized by a longitudinal axis; and at least first and second distinguishable laser diodes, wherein the first and second laser diodes are positioned to direct respective first and second laser beams toward the target when the barrel is pointed toward the target, the first and second laser diodes are positioned to direct the first and second laser beams at different respective angles relative to the barrel's longitudinal axis, and the first and second beams form respective first and second spots on the target, the relative positions of the first and second spots depending on the distance from the firearm to the target, thereby helping the user compensate for bullet trajectory.

5. The firearm of claim 4 wherein the first and second laser diodes are on opposite sides of the barrel.

6. The firearm of claim 4 wherein the first and second laser beams are directed along respective axes that converge toward each other.

7. The firearm of claim 4 wherein:

the first and second laser diodes are on opposite sides of the barrel; and the first and second laser beams are directed along respective axes that converge toward each other.

8. The firearm of claim 7 wherein each of the beams converges toward the barrel's longitudinal axis.

9. The firearm of claim 4 wherein the first and second laser beams have different respective colors.

10. The firearm of claim 4 wherein the first and second laser beams have different respective projected shapes.

* * * * *